US009150020B2

(12) United States Patent
Lee et al.

(10) Patent No.: US 9,150,020 B2
(45) Date of Patent: Oct. 6, 2015

(54) LIQUID DROPLET DISCHARGE APPARATUS

(71) Applicants: SAMSUNG DISPLAY CO., LTD., Yongin, Gyeonggi-Do (KR); UNIST, Academy-Industry Research Corporation, Ulsan (KR)

(72) Inventors: Dae-Young Lee, Seoul (KR); Hyang-Shik Kong, Seongnam-si (KR); Jung Gun Nam, Seoul (KR); Gug Rae Jo, Asan-si (KR); Hyung Bin Cho, Seongnam-si (KR); Byeong Wan Ahn, Yongin-si (KR); Jan Ung Park, Ulsan (KR)

(73) Assignees: Samsung Display Co., Ltd., Yongin-si (KR); Unist Academy-Industry Research Corporation, Ulsan (KR)

( * ) Notice: Subject to any disclaimer, the term of this patent is extended or adjusted under 35 U.S.C. 154(b) by 0 days.

(21) Appl. No.: 14/294,126

(22) Filed: Jun. 2, 2014

(65) Prior Publication Data

US 2015/0138278 A1 May 21, 2015

(30) Foreign Application Priority Data

Nov. 18, 2013 (KR) ..... 10-2013-0139975

(51) Int. Cl.
*B41J 2/135* (2006.01)
*B41J 2/06* (2006.01)
*B41J 2/14* (2006.01)

(52) U.S. Cl.
CPC ..... *B41J 2/1433* (2013.01)

(58) Field of Classification Search
USPC ..... 347/45, 55
See application file for complete search history.

(56) References Cited

U.S. PATENT DOCUMENTS

| | | | | |
|---|---|---|---|---|
| 6,673,386 | B2 | 1/2004 | Komyoji et al. | |
| 7,604,326 | B2 | 10/2009 | Nishio et al. | |
| 8,118,414 | B2 | 2/2012 | Tsuchiya et al. | |
| 8,235,506 | B2 | 8/2012 | Nishio et al. | |
| 2008/0151006 | A1* | 6/2008 | Nishio et al. | 347/55 |
| 2008/0273061 | A1* | 11/2008 | Tsuchiya et al. | 347/55 |
| 2011/0187798 | A1* | 8/2011 | Rogers et al. | 347/55 |
| 2012/0105528 | A1* | 5/2012 | Alleyne et al. | 347/14 |

FOREIGN PATENT DOCUMENTS

| | | | |
|---|---|---|---|
| KR | 10-0919411 | B1 | 9/2009 |
| KR | 10-2009-0111009 | A | 10/2009 |

(Continued)

OTHER PUBLICATIONS

Burns, S.E., et al., Inkjet Printing of Polymer Thin-Film Transistor Circuits, *MRS Bulletin*, Nov. 2003, vol. 28, Nov. 2003, (www.mrs.org/publications/bulletin), pp. 829-834.

Kung, C-Y., et al., Single-molecule analysis of ultradilute solutions with guided streams of 1-μm water droplets, *Applied Optics*, vol. 38, No. 9, Mar. 20, 1999, pp. 1481-1487.

(Continued)

*Primary Examiner* — Jason Uhlenhake

(74) *Attorney, Agent, or Firm* — Christie, Parker & Hale, LLP

(57) ABSTRACT

A liquid droplet discharge apparatus that discharges liquid droplets finely and stably and includes a liquid droplet discharge unit and a voltage applying unit that is connected to the liquid droplet discharge unit, the liquid droplet discharge unit includes a nozzle and a tube that surrounds the nozzle, and the nozzle and the tube are coated with metal.

16 Claims, 31 Drawing Sheets

(56) References Cited

FOREIGN PATENT DOCUMENTS

| | | | | |
|---|---|---|---|---|
| KR | 10-101182 | B1 | | 1/2011 |
| KR | 10-1097171 | B1 | | 12/2011 |
| KR | 101097171 | A | * | 12/2011 |
| KR | 10-2012-0015798 | A | | 2/2012 |
| KR | 10-2012-0050277 | A | | 5/2012 |
| KR | 10-1249723 | B1 | | 3/2013 |

OTHER PUBLICATIONS

Okamoto, T., Microarray fabrication with covalent attachment of DNA using Bubble Jet technology, *Nature Biotechnology*, vol. 18, Apr. 2000 (http://biotech.nature.com), pp. 438-441.

Wang, J.Z., Dewetting of conducting polymer inkjet droplets on patterned surfaces, *Nature Materials*, vol. 3, Mar. 2004 (www.nature.com/naturematerials), pp. 171-176.

* cited by examiner line width: 3.5 ± 0.21 μm line space: 5 ± 0.26 μm line width: 5 ± 0.23 μm line space: 5 ± 0.31 μm

LIQUID DROPLET DISCHARGE APPARATUS

CROSS-REFERENCE TO RELATED APPLICATION

This application claims priority to and the benefit of Korean Patent Application No. 10-2013-0139975, filed in the Korean Intellectual Property Office on Nov. 18, 2013, the entire content of which is incorporated herein by reference.

BACKGROUND

1. Field

The present invention relates to a liquid droplet discharge apparatus.

2. Description of the Related Art

In order to ensure price competiveness in various industry fields such as semiconductors, displays, PCBs and solar cells, it is required to form a finer pattern in a low-cost process. In a photolithography process, a pattern is formed by depositing a material of a pattern desired to be formed on the entire surface and allowing light to illuminate the entire surface through a mask of the desired pattern. Unfortunately, the photolithography process has drawbacks such as process cost increases due to multiple processes, materials are excessively consumed, and waste increases. In order to solve the drawbacks of the photolithography process, there has been developed an inkjet process in which a pattern is formed by applying heat or mechanical pressure to discharge liquid droplets through a nozzle and a solvent is dried to allow only the necessary material to remain on a substrate. Disadvantageously, there is a drawback in that it is difficult to discharge fine liquid droplets of 10 μmm or less.

In order to overcome the limitations of the inkjet process, there has been developed an electrostatic type liquid droplet discharge technology utilizing a capillary. The electrostatic type liquid droplet discharge technology is a technology that applies a high voltage between the capillary and the substrate to discharge liquid droplets by an electrostatic force. Further, in the electrostatic type liquid droplet discharge technology, multiples nozzles are needed for mass production. However, in this technology of applying voltage to the nozzle to control discharge, when multiple nozzles are implemented, there is a problem of electrical conduction through an ink supply path.

In order to manufacture multiple nozzles, although a method of finely processing a silicon substrate has been introduced, since the nozzle made from silicon substrate has conductivity, an electric field is not concentrated on the ink within the nozzle. For this reason, since the intensity of the electric field is changed, a discharge voltage may increase or the nozzle may be clogged. Accordingly, there is a problem in that it is difficult to stably discharge the ink.

The above information disclosed in this Background section is only for enhancement of an understanding of the background of the invention and therefore it may contain information that does not form the prior art that is already known to a person of ordinary skill in the art.

SUMMARY

The present invention has been made in an effort to provide a liquid droplet discharge apparatus configured to discharge stably fine liquid droplets by applying a voltage between a nozzle and a tube that surrounds the nozzle.

An exemplary embodiment of the present invention provides a liquid droplet discharge apparatus including a liquid droplet discharge unit, and a voltage applying unit that is connected to the liquid droplet discharge unit. The liquid droplet discharge unit includes a nozzle and a tube that surrounds the nozzle, and the nozzle and the tube are coated with metal.

The voltage applying unit may apply different voltages to the nozzle and the tube.

The nozzle may have a diameter of approximately 0.3 μm to approximately 30 μm.

Hydrophobic treatment may be performed on one end of the nozzle.

The hydrophobic treatment may be performed using a solvent containing thiol.

The solvent may contain fluoro compounds.

One end of the nozzle on which the hydrophobic treatment is performed using the solvent may be self-assembled.

The voltage applying unit may apply a ground voltage to the tube.

The nozzle may be plural in number.

The nozzle may be made of polymer or silicon.

The liquid droplet discharge unit may further include a pressure controller that is connected to the liquid droplet discharge unit.

The liquid droplet discharge unit may further include an ink loading unit that is connected to the liquid droplet discharge unit.

The liquid droplet discharge unit may further include a supporting member on which a substrate is disposed, and the voltage applying unit may be connected to the supporting member.

When the nozzle is made of the silicon, the liquid droplet discharge apparatus may further include an insulating layer that is connected to the nozzle.

The nozzles may include fluid supply channels, respectively.

Parts of the plurality of nozzles may include the fluid supply channels, respectively, and the fluid supply channels may be spaced apart from one another at a predetermined distance.

The predetermined distance may be at least approximately 500 μm or more.

The apparatus for discharging the liquid droplets by applying voltages to the nozzle and the tube that surrounds the nozzle can form a fine pattern. That is, it is possible to implement various thicknesses and line widths of the pattern. Further, it is possible to stably discharge the liquid droplets regardless of the substrate onto which the liquid droplets are discharged. Furthermore, it is possible to provide a high-resolution panel through the fine pattern.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
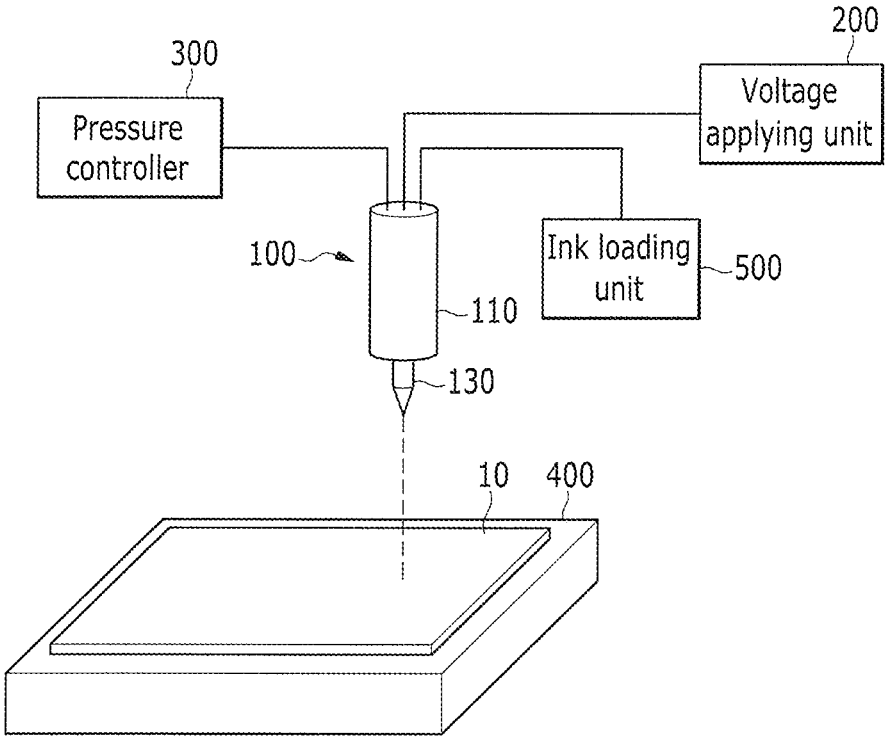
FIG. 1 is a schematic diagram of a liquid droplet discharge apparatus according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Throughout the present specification, in addition, unless explicitly described to the contrary, the word "comprise" and variations such as "comprises" or "comprising", will be understood to imply the inclusion of stated elements but not the exclusion of any other elements.

The terms "approximately" and "substantially" used in the specification are used to refer to the same value as or a value closer to a specific permissible error in manufacture and materials, and are also used to prevent an unconscious infringer from improperly using the disclosure where accurate or absolute values are mentioned to help with an understanding of the present specification.

Figure 2A:
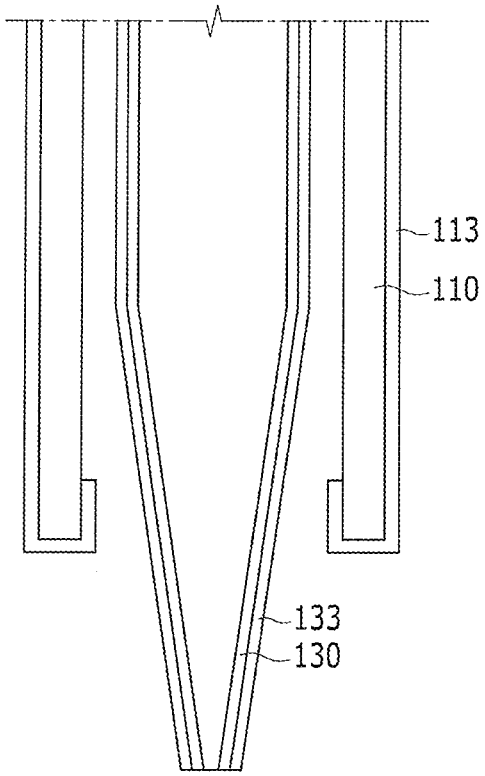
FIG. 2A is a detailed view of a discharge unit according to an exemplary embodiment of the present invention.
Figure 2B:
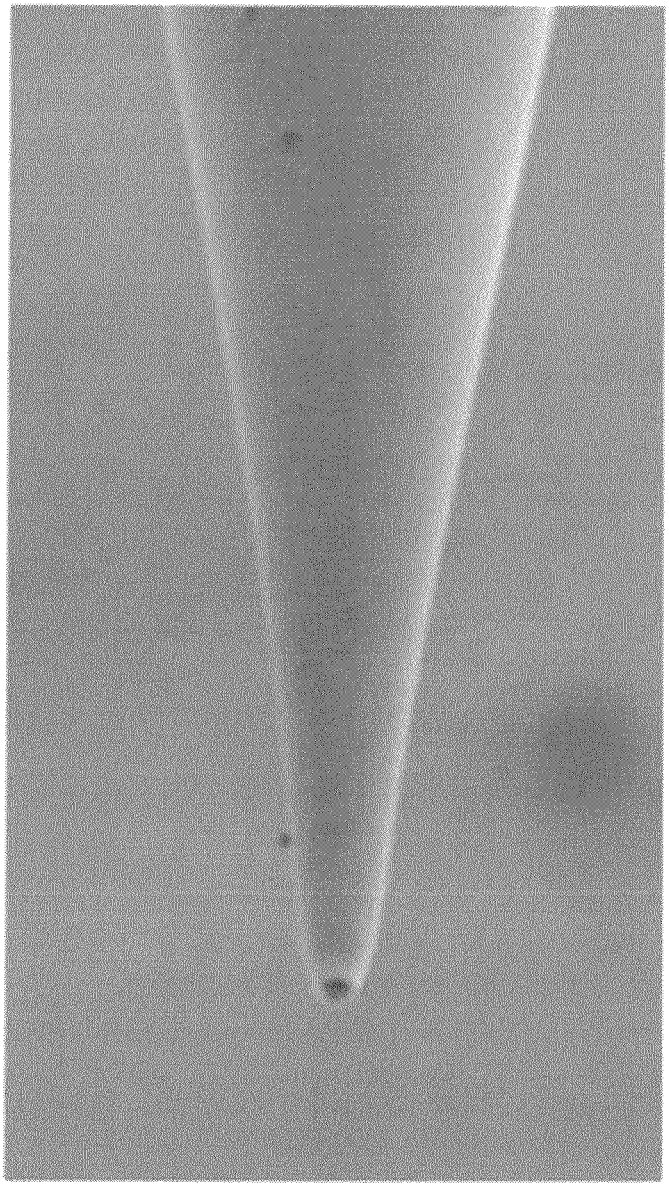
FIG. 2B is an image of the discharge unit of FIG. 2A.

First, a liquid droplet discharge apparatus according to an exemplary embodiment of the present invention will be explained with reference with FIGS. 1, 2A and 2B. FIG. 1 is a schematic diagram of the liquid droplet discharge apparatus according to the exemplary embodiment of the present invention, FIG. 2A is a detailed view of a liquid droplet discharge unit according to an exemplary embodiment of the present invention, and FIG. 2B is an image of the liquid droplet discharge unit according to the exemplary embodiment of the present invention.

The liquid droplet discharge apparatus includes a liquid droplet discharge unit 100, a voltage applying unit 200, a pressure controller 300, a supporting member 400, and an ink loading unit 500, and forms a pattern required by a user.

First, the liquid droplet discharge unit 100 includes a tube 110 and a nozzle 130, and discharges liquid droplets onto a substrate 10 onto which the liquid droplets are discharged.

The tube 110 may have a cylindrical shape so as to surround the nozzle 130 and separately receives a voltage from the voltage applying unit 200. The tube 110 generates an electric field through the received voltage by cooperating with the nozzle 130 and applies an electrostatic force to ink stored in the nozzle 130.

Figure 3A:
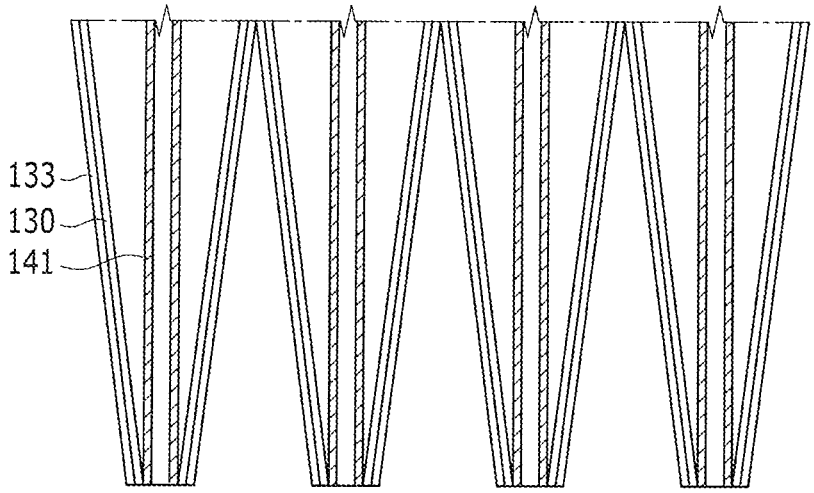
FIG. 3A-C are detailed views of a discharge unit according to other exemplary embodiments of the present invention.
Figure 3B:
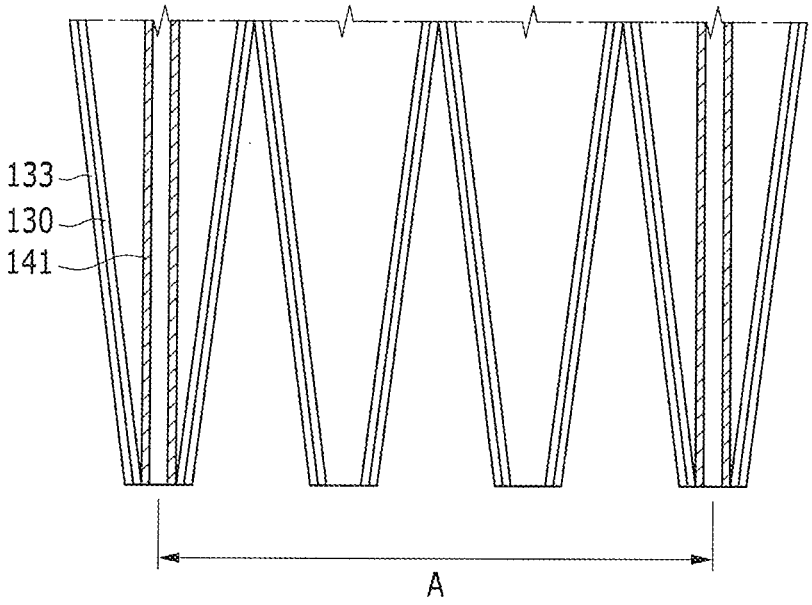
Figure 3C:
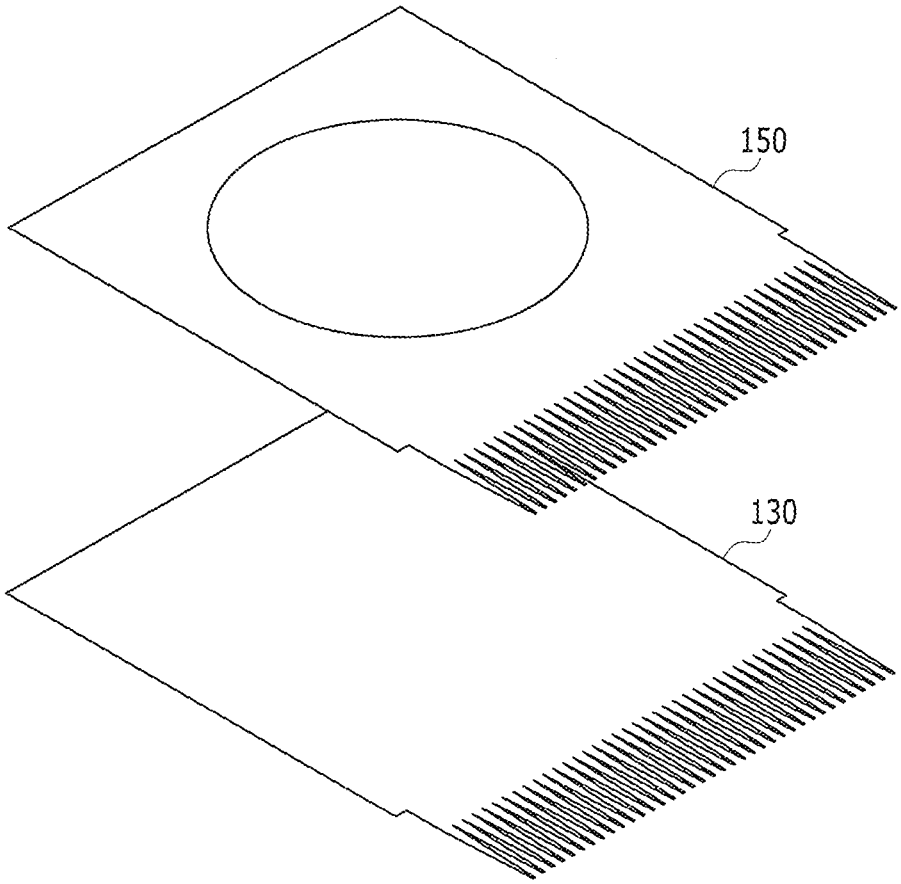

The tube 110 may be made of an insulating material, for example, glass or a polymer. However, the material of the tube is not limited to the above-mentioned materials, and the tube 110 may be made of a silicon material. When the tube 110 and the nozzle 130 are made of silicon material, the apparatus may further include an insulating layer 150 as shown in FIG. 3C.

Further, the tube 110 includes a first coating layer 113. The first coating layer 113 is a layer coated with metal and is formed to apply the voltage to the tube 110 made of the insulating material.

The first coating layer 113 may be coated with any metal or any alloy which receives the voltage to allow a current to flow, and the material of the first coating layer may be, for example, copper (Cu), aluminum (Al), chromium (Cr), and gold (Au).

The first coating layer 113 is coated on the tube 110 to an extent capable of applying the voltage to the tube, and a coating area and a coating position thereof are not limited. For example, the first coating layer may be coated on an outer surface of the tube 110 in order to easily form the coating layer or may be partially coated on an inner surface of the tube 110 in order to effectively generate the electric field by a voltage applied to the nozzle 130 and the voltage applied to the tube.

A part of the nozzle 130 may be positioned along the inside of the tube 110, and one end of the nozzle 130 serving as the other part thereof may be exposed to the outside of the tube 110. The liquid droplets such as ink are discharged onto the substrate from the one end of the nozzle 130.

The nozzle 130 may be made of the same insulating material as that of the tube 110, and the material of the nozzle may include, for example, silicon (Si). However, the material of the nozzle is not limited to the aforementioned material, and may include a polymer such as polydimethylsiloxane (PDMS).

The nozzle 130 includes a second coating layer 133. The second coating layer 133 is coated with metal and is formed to apply to the voltage to the nozzle 130 made of the insulating material.

The second coating layer 133 is coated on an outer surface of the nozzle 130. The second coating layer 133 is coated to an extent capable of applying the voltage to the nozzle 130, and a coating area and a coating position of the second coating layer are not limited. For example, the second coating layer is coated on the outer surface of the nozzle 130 in order to easily form the coating layer. Particularly, the second coating layer may be coated up to an upper side of the nozzle 130, that is, the other end opposite to the one end exposed to the outside in order to easily connect the nozzle and the voltage applying unit 200. When the second coating layer is coated at only the one end exposed to the outside, it is difficult for the nozzle to be connected to the voltage applying unit 200. Accordingly, the second coating layer is coated up to the other end that is not exposed to the outside and is easily connected to the voltage applying unit 200.

The nozzle 130 may have a diameter of approximately 0.3 μm to approximately 30 μm. As stated above, when the nozzle 130 having a small diameter is used, it is possible to achieve fine printing. However, when the nozzle having a small diameter is merely used, since the nozzle is clogged by the ink, it is difficult to form the pattern. Accordingly, according to the exemplary embodiment of the present invention, when the nozzle having a small diameter is used while forming the electric field, the nozzle is not clogged.

Furthermore, the one end of the nozzle 130 facing the substrate may have a diameter smaller than that of the other end opposite to the one end. That is, the other end of the nozzle 130 connected to the voltage applying unit 200 and the ink loading unit 500 may have a diameter larger than that of the one end, from which the liquid droplets are discharged and which is exposed to the outside.

Hydrophobic treatment is performed on the one end of the nozzle 130, which is exposed to the outside from which the liquid droplets are discharged. In general, when the liquid droplets are discharged through the nozzle 130, some of the discharged liquid droplets move up along the outer surface of the nozzle 130. However, in the liquid droplet discharge apparatus according to the exemplary embodiment of the present invention, since the hydrophobic treatment is performed on the one end of the nozzle 130, it is possible to prevent the liquid droplets from moving up.

For the hydrophobic treatment method, the one end of the nozzle 130 may be coated with a hydrophobic solvent, for example. For the hydrophobic solvent, any solvent having hydrophobic properties may be used. Alternatively, a solvent containing thiol may be used, or a solvent containing fluoro compounds may be used. For example, a solvent containing both of thiol and fluoro, such as 1H,1H,2H,2H-perfluorodecane-1-thiol, may be used, but the solvent is not limited to this example.

The one end of the nozzle 130 on which the hydrophobic treatment is performed is self-assembled and has the same function as a hydrophobic coating layer. The discharged liquid droplets do not move up along the outer surface of the nozzle 130 from the one end of the nozzle 130 and are discharged onto the substrate. Accordingly, it is possible to stably form a fine pattern and to reduce a loss of a material moving along the outer surface.

The voltage applying unit 200 is connected to the liquid droplet discharge unit 100 to apply the voltages to the tube 110 and the nozzle 130. The liquid droplet discharge apparatus according to the exemplary embodiment of the present invention discharges the liquid droplets within the nozzle 130 by using the electric field formed by the voltages applied to the tube 110 and the nozzle 130, so that it is possible to form a high-height pattern that can be finely controlled.

The voltage applying unit 200 applies different voltages to the tube 110 and the nozzle 130, respectively, to generate the electric field by a voltage difference therebetween. When the voltage is applied to the nozzle 130, the voltage is also applied to the ink to generate an electric field between the tube 110 and the ink. When the electrostatic force caused by the electric field is equal to or greater than a certain value, the ink is intermittently or continuously discharged onto the substrate 10. At this time, the tube 110 may receive a ground voltage to form the electric field.

The pressure controller 300 is connected to the ink loading unit 500 and adjust a pressure so as to allow the ink to move to the liquid droplet discharge unit 100. Any method for adjusting the pressure may be used, and the pressure may be controlled using, for example, a hydraulic pressure method.

The supporting member 400 is spaced apart from the liquid droplet discharge unit 100 so as to face the liquid droplet discharge unit, and the substrate 10 is mounted on the supporting member 400. The liquid droplets are discharged onto the substrate 10 to form the pattern.

The voltage applying unit 200 is connected to the tube 110 and the nozzle 130 to apply the voltages thereto, but may be connected to the supporting member 400. When the voltage applying unit is connected to the supporting member 400, an electric field is generated between the liquid droplet discharge unit 100 and the substrate 10, so that it is possible to discharge the liquid droplets.

The ink loading unit 500 includes a discharging agent discharged with the ink and supplies the discharge agent to the liquid droplet discharge unit 100. The ink loading unit 500 is connected to the liquid droplet discharge unit 100. Any method for supplying the ink may be used, and for example, when the ink is supplied to the ink loading unit 500, the ink is moved from the ink loading unit 500 to the liquid droplet discharge unit 100 due to a capillary action.

A liquid droplet discharge apparatus according to other exemplary embodiments of the present invention will be described with reference to FIGS. 3A, 3B and 3C. FIG. 3A is a cross-sectional view of a liquid droplet discharge unit 100 according to another exemplary embodiment of the present invention, FIG. 3B is a cross-sectional view of a liquid droplet discharge unit 100 according to another exemplary embodiment of the present invention, and FIG. 3C is a perspective view of a partial configuration (a nozzle and an insulating layer) according to another exemplary embodiment of the present invention. The same or similar constituent elements as or to those of the exemplary embodiment of the present invention are not described below.

Referring to FIG. 3A, the liquid droplet discharge unit 100 according to another exemplary embodiment of the present invention includes a plurality of nozzles. The plurality of nozzles may be made of, for example, a polymer such as polydimethylsiloxane (PDMS) or silicon. However, the material of the nozzle is not limited to the aforementioned polymer, and may be any polymer. When the nozzle is made of the polymer, it is possible to easily manufacture a plurality of nozzles with a lower cost.

The liquid droplet discharge unit 100 may include a fluid supply channel 141 disposed within each of the nozzles 130. The ink is sent to the one end of the nozzle 130 through the fluid supply channel 141, so that it is possible to form the fine pattern.

The fluid supply channel 141 may have a diameter of approximately 10 μm, but is not limited thereto. The fluid supply channel may be adjusted to have various diameters depending on diameters of the nozzle 130 and the tube 110.

Referring to the exemplary embodiment illustrated in FIG. 3B, in the exemplary embodiment illustrated in FIG. 3A, all of the plurality of nozzles include the fluid supply channel 141, whereas in the exemplary embodiment FIG. 3B, only parts of the plurality of nozzles include the fluid supply channels 141, respectively. In the present exemplary embodiment, the nozzles 130 each including no fluid supply channel do not discharge the liquid droplets, and only the nozzles 130 each including the fluid supply channel 141 can discharge the liquid droplets.

At this time, there may be a predetermined distance A between the nozzles 130 each including the fluid supply channel 141, and the predetermined distance A may be at least approximately 500 μm or more. That is, the distance A between the fluid supply channels 141 may be at least approximately 500 μm or more. It is possible to stably form a finer pattern due to the distance.

Meanwhile, in the exemplary embodiment illustrated in FIG. 3B, the nozzle 130 may be made of silicon, and the apparatus may further include an insulating layer 150 connected to the nozzle 130 made of the silicon, as shown in FIG. 3C. The insulating layer 150 is formed to prevent the voltage from being applied to an unnecessary position, and the insulating layer 150 may be formed on a position other than the position where the voltage is applied. Hereinafter, fine patterns formed by the liquid droplet discharge apparatus according to the exemplary embodiment of the present invention and fine patterns according to Comparative Examples will be described with reference to FIGS. 4A to 15B.

Figure 4A:
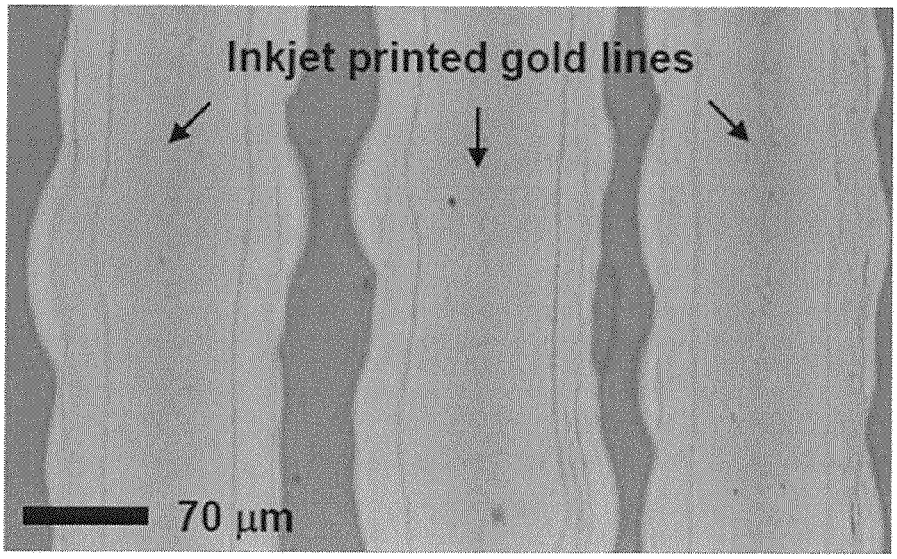
FIGS. 4A to 15B show patterns formed by the liquid droplet discharge apparatus according to the exemplary embodiment of the present invention and images of Comparative Examples.
Figure 4B:
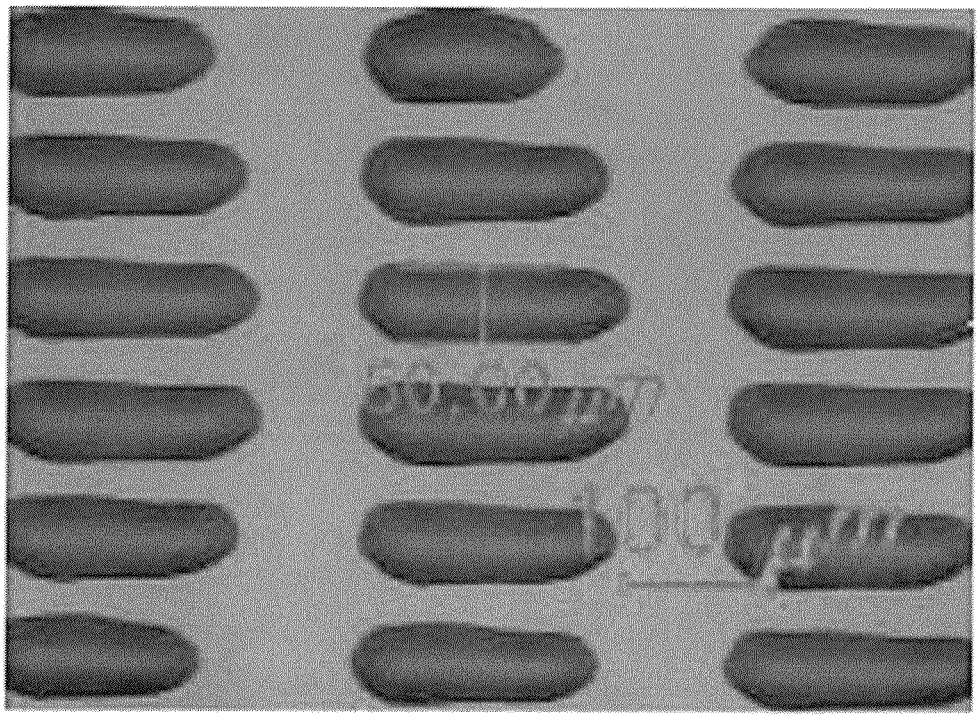

First, FIGS. 4A and 4B show fine patterns formed according to Comparative Example.

As can be seen from FIG. 4A, when wirings are patterned, the wirings each having an irregular and uneven shape are formed. Further, the patterns shown in FIG. 4B are formed such that distances between the patterns are not uniform and a size and a thickness of the pattern are not uniform.

As mentioned above, when fine patterns are formed, since the patterns are generally formed irregularly and non-uniformly, it is difficult to form high-quality fine patterns.

Figure 5A:
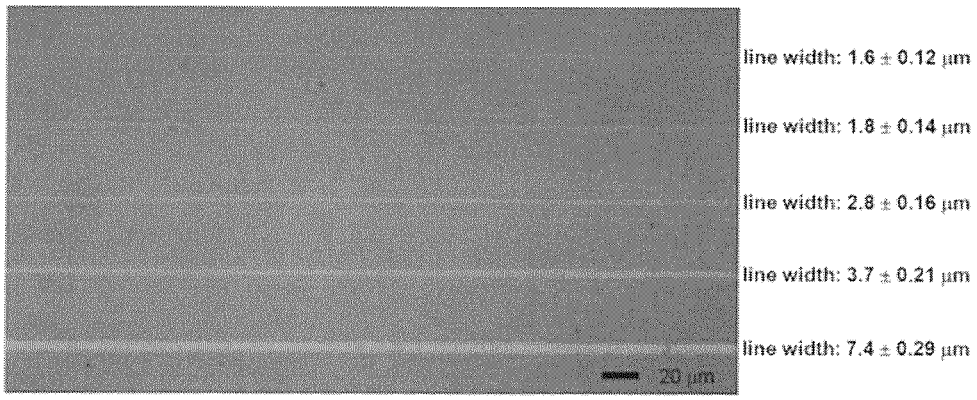
Figure 5B:
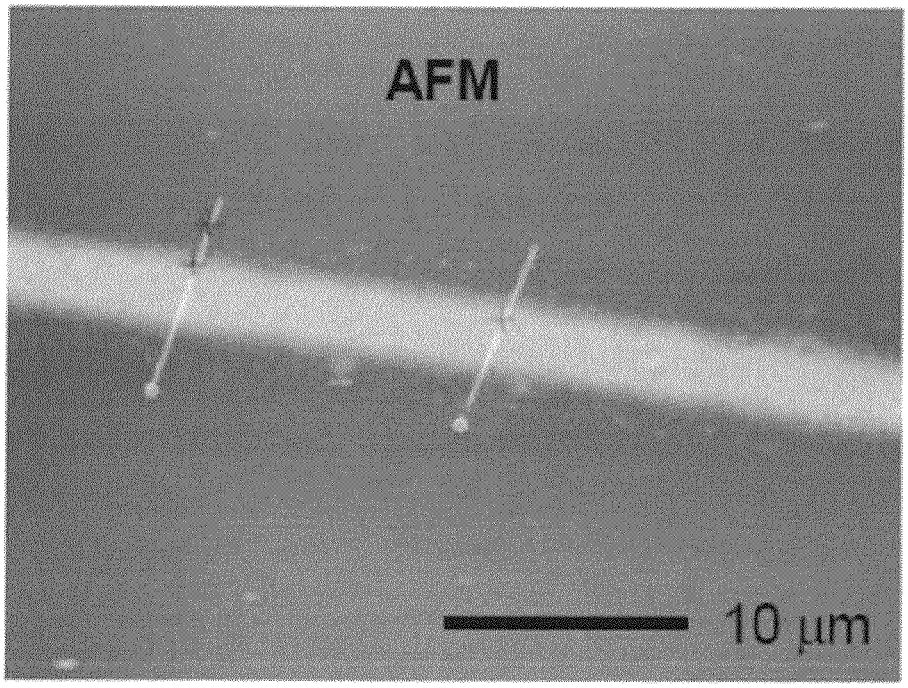
Figure 5C:
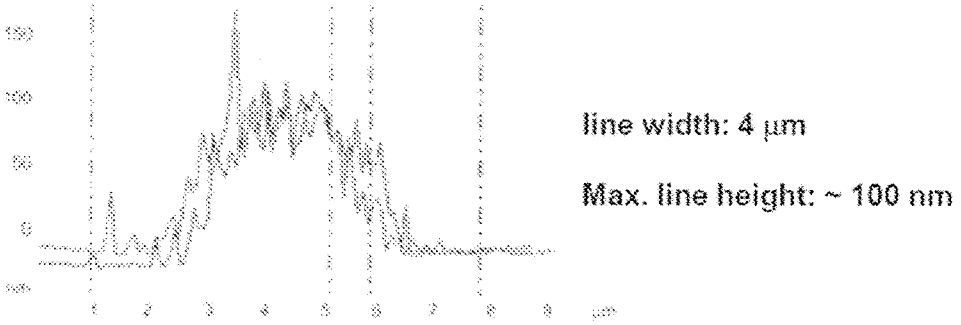

FIGS. 5A to 5C show wirings patterned by the liquid droplet discharge apparatus according to the exemplary embodiment of the present invention and an analysis graph of the wirings. Ag nano particle ink is used for patterning.

FIG. 5A shows five fine wirings. The wirings have thicknesses of approximately 1.6±0.12 μm, approximately 1.8±0.14 μm, approximately 2.8±0.16 μm, approximately 3.7±0.21 μm, approximately 7.4±0.29 μm in sequence from top to bottom. That is, a fine pattern having a maximum thickness of approximately 1.6 μm is formed.

When compared with the wirings of FIGS. 4A and 4B, the irregularity of the patterns according to Comparative Example is observed with the naked eye, but when the liquid droplet discharge apparatus according to the exemplary embodiment of the present invention is used, the fine patterns are delicately formed.

It can be seen from FIG. 5B that even when one wiring is enlarged by AFM, a uniform pattern is formed. Also, it can be seen from FIG. 5C that one wiring has width of 4 μm on average.

Figure 6A:
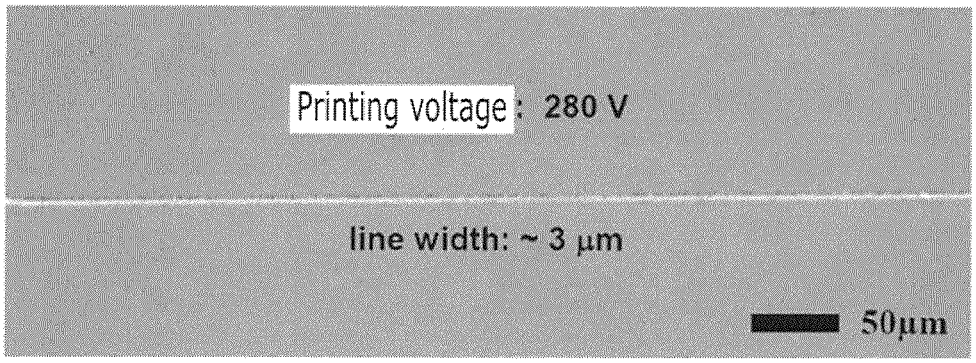

Next, referring to FIG. 6A, fine patterns are formed on a glass substrate having a thickness of approximately 210 μm by the liquid droplet discharge apparatus according to the exemplary embodiment of the present invention. At this time, a voltage of approximately 280 V is applied to the nozzle, and printed patterns are uniformly formed at a thickness of approximately 3 μm.

Figure 6B:
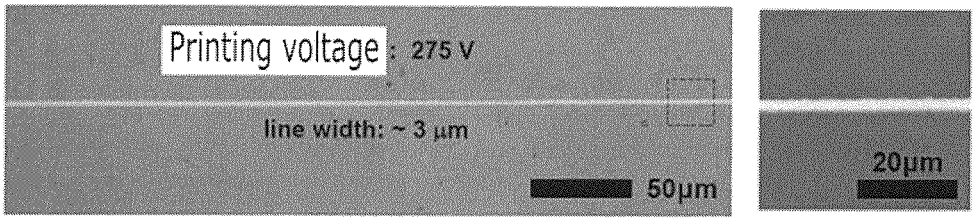

Further, referring to FIG. 6B, even when a voltage of 275 V is applied to a glass substrate of a maximum thickness of approximately 1.06 mm, wirings each having a thickness of approximately 3 μm are uniformly printed.

That is, when the liquid droplet discharge apparatus according to the exemplary embodiment of the present invention is used, it can be seen that the fine patterns are uniformly formed regardless of the thickness of the substrate.

Figure 7A:
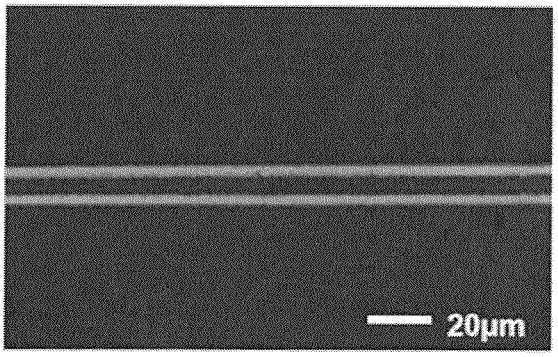
Figure 7B:
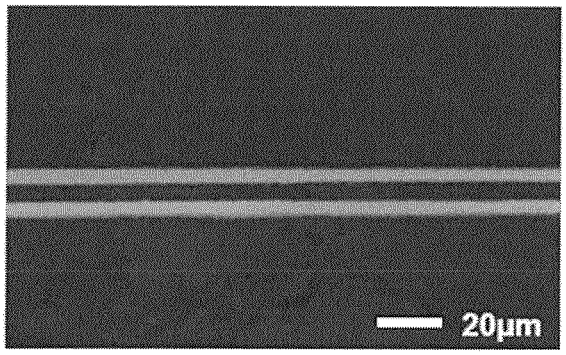

Next, a distance between two or more patterns will be examined with reference to FIGS. 7A and 7B.

As can be seen from FIG. 7A, each of printed wirings has a thickness of approximately 3.5±0.21 μm, and a distance between the wirings is approximately 5±0.26 μm.

Moreover, as can be seen from FIG. 7B, each of printed wirings has a thickness of approximately 5±0.23 μm, and a distance between the wirings is approximately 5±0.31 μm.

That is, it can be seen that each of the wirings is printed as a fine pattern and the distance between the printed wirings is approximately 5 μm to thereby form a fine pattern.

Figure 8A:
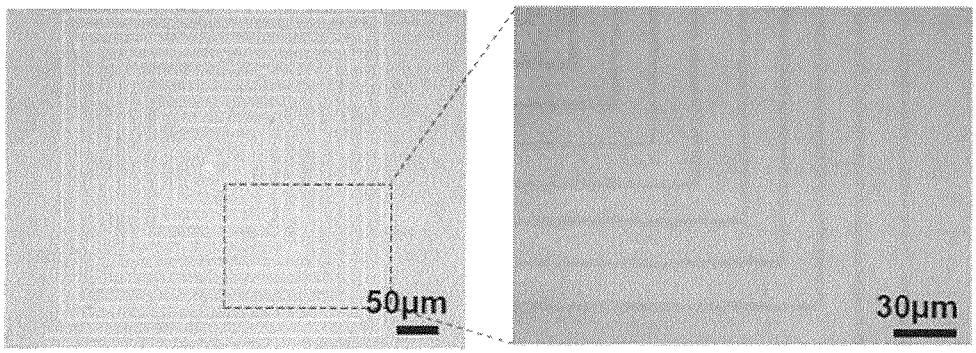
Figure 8B:
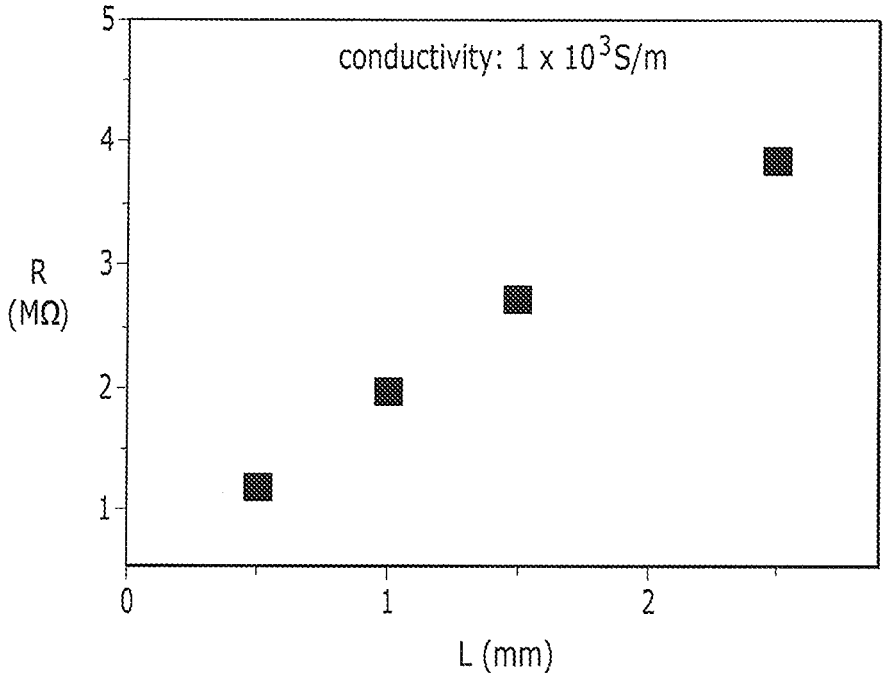

Next, referring to FIGS. 8A and 8B, a pattern shown in FIG. 8A is formed using Copper (Cu) nano particle ink (a particle size of approximately 5 to 20 nm).

The pattern shown in FIG. 8A is a continuous quadrangle pattern having a thickness of approximately 3 μm. As can be seen from the right hand drawing illustrating the enlarged pattern, the fine pattern having a uniform wiring width and a uniform distance between the wirings can be formed.

Particularly, referring to FIG. 8B, it can be seen that as a length of the pattern of FIG. 8A increases, a resistance increases. This shows that physical properties that are generally predictable when the fine pattern is stably formed are exhibited.

Next, FIGS. 9A to 9E show images for describing a procedure of forming a pattern having a certain height by the liquid droplet discharge apparatus according to the exemplary embodiment of the present invention, and silver (Ag) nano particle ink is used.

Referring to FIGS. 9A to 9E, the liquid droplet discharge apparatus according to the exemplary embodiment of the present invention can continuously form a fine pattern and also form a pattern having a certain height. That is, the printing is performed so as to continuously pile up ink on one spot while continuously discharging liquid droplets onto the one spot. It can be seen that as the printing proceeds from FIG. 9A to FIG. 9E, a height of the pattern becomes high, and the pattern is printed to have a maximum height of 73 μm.

Figure 9A:
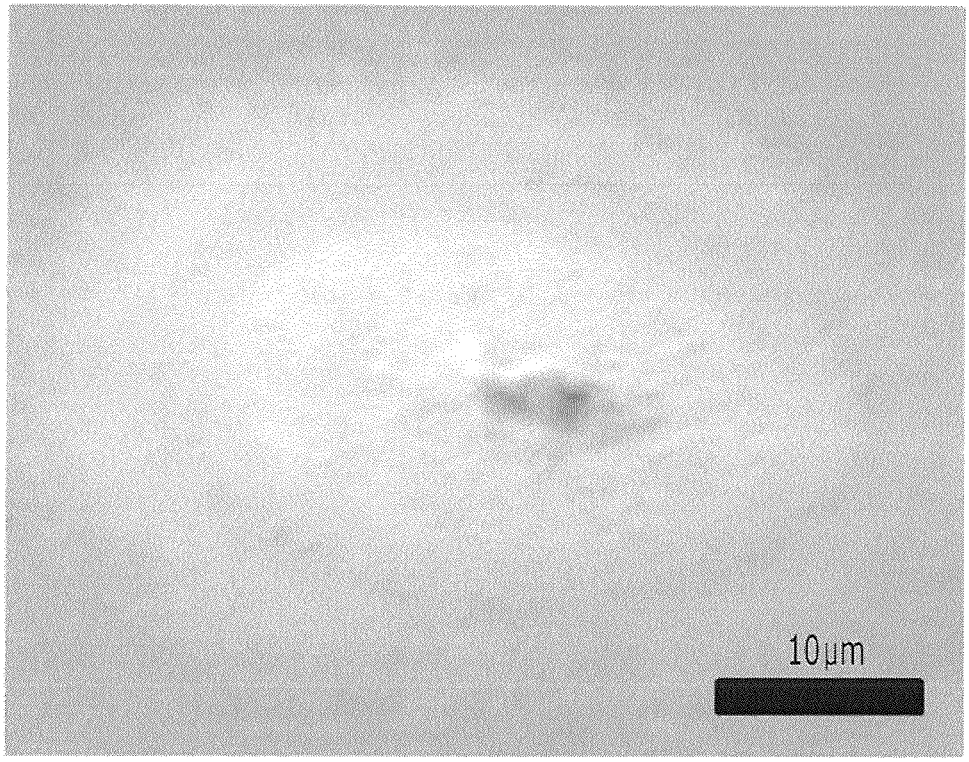
Figure 9B:
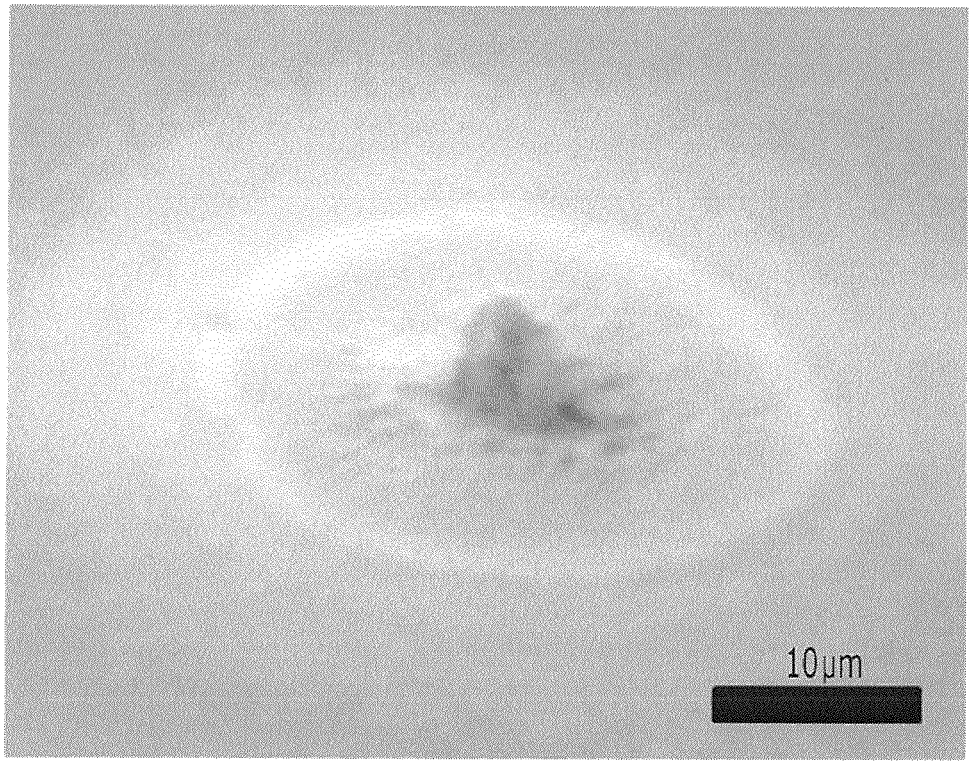
Figure 9C:
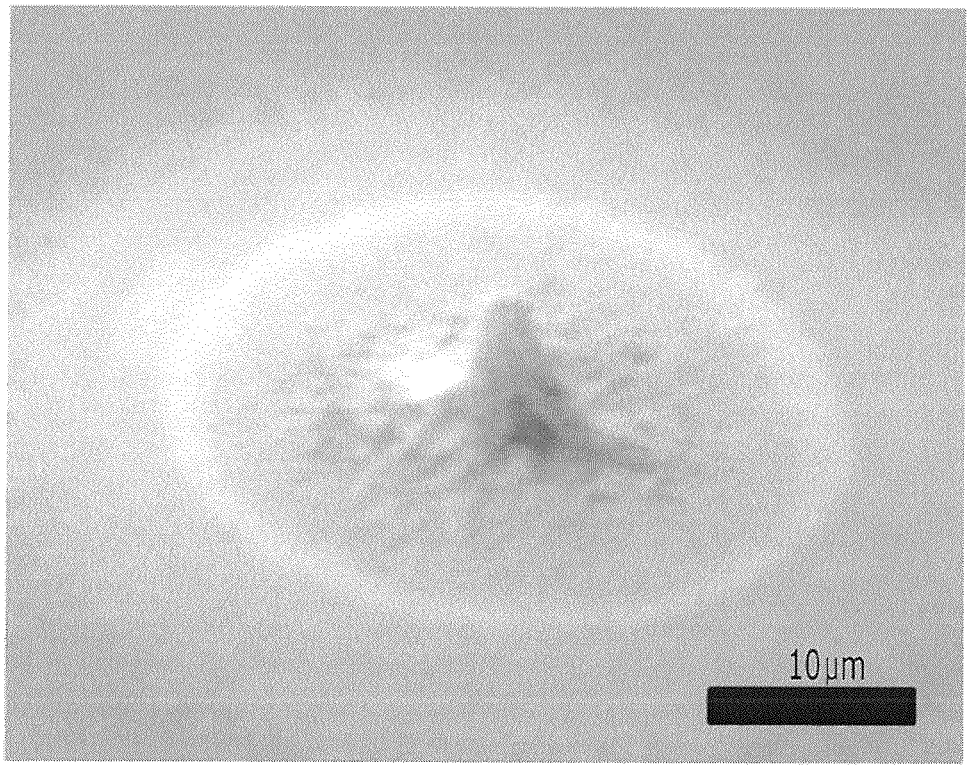
Figure 9D:
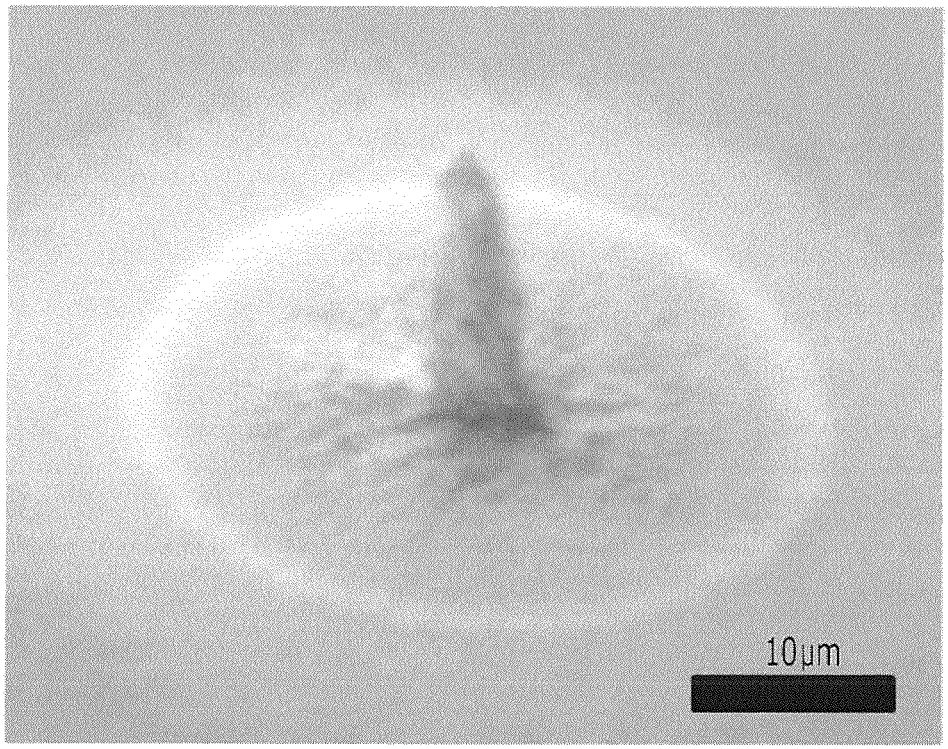
Figure 9E:
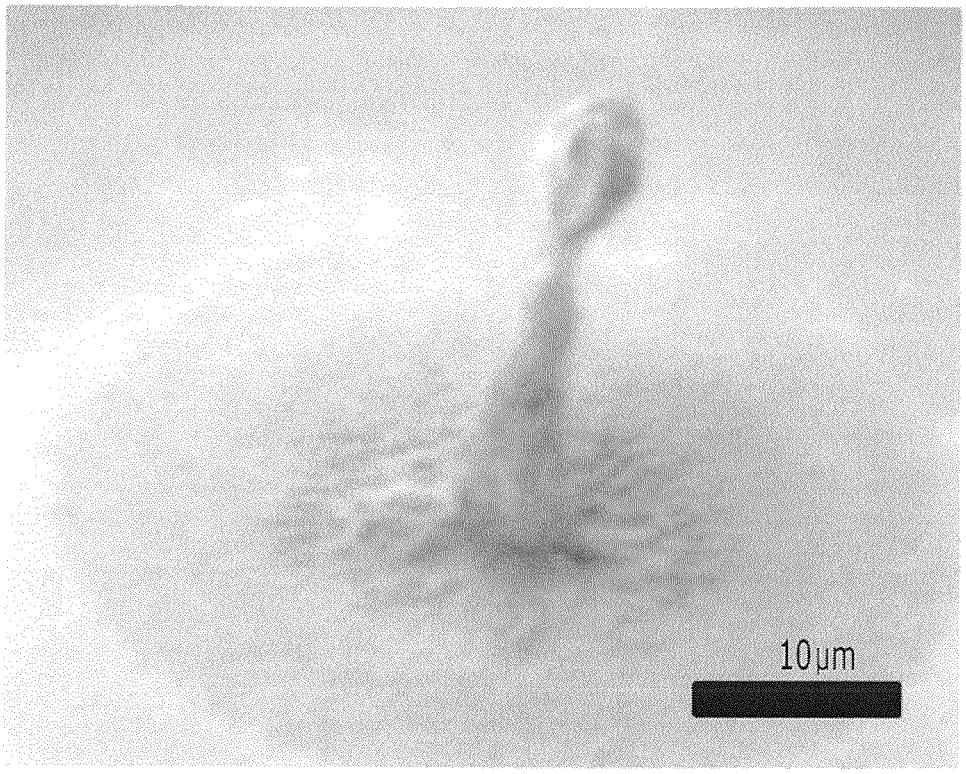
Figure 10:
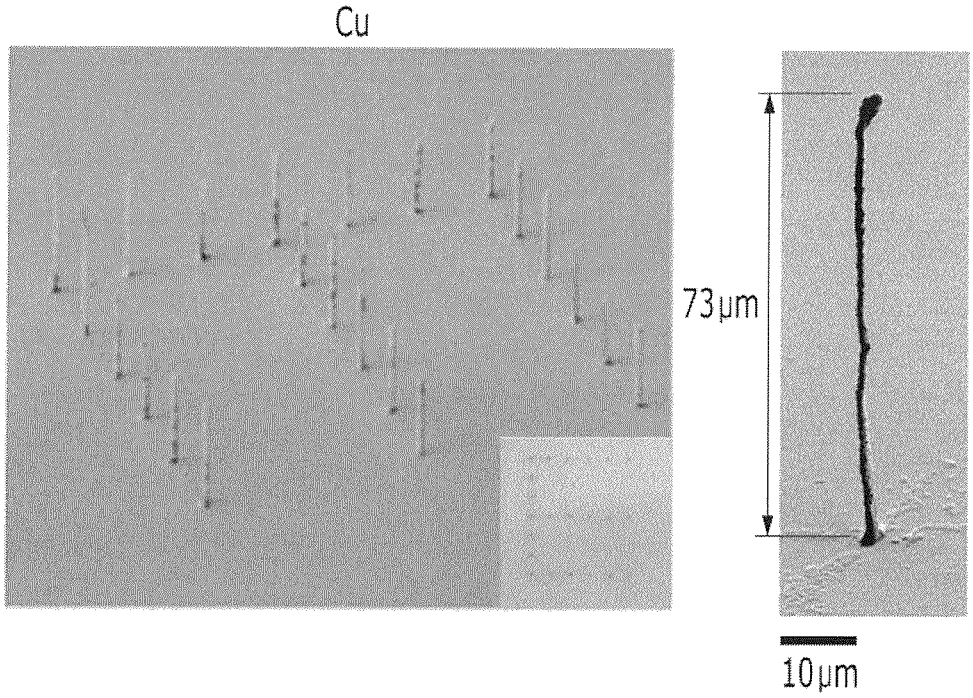

FIG. 10 illustrates a case where the pattern is plural in number. Unlike FIG. 9, in FIG. 10, copper (Cu) nano particle ink is used, and the patterns having the same height are formed to be spaced apart from one another at the same interval. At this time, one pattern may have a height of approximately 73 μm.

Figure 11:
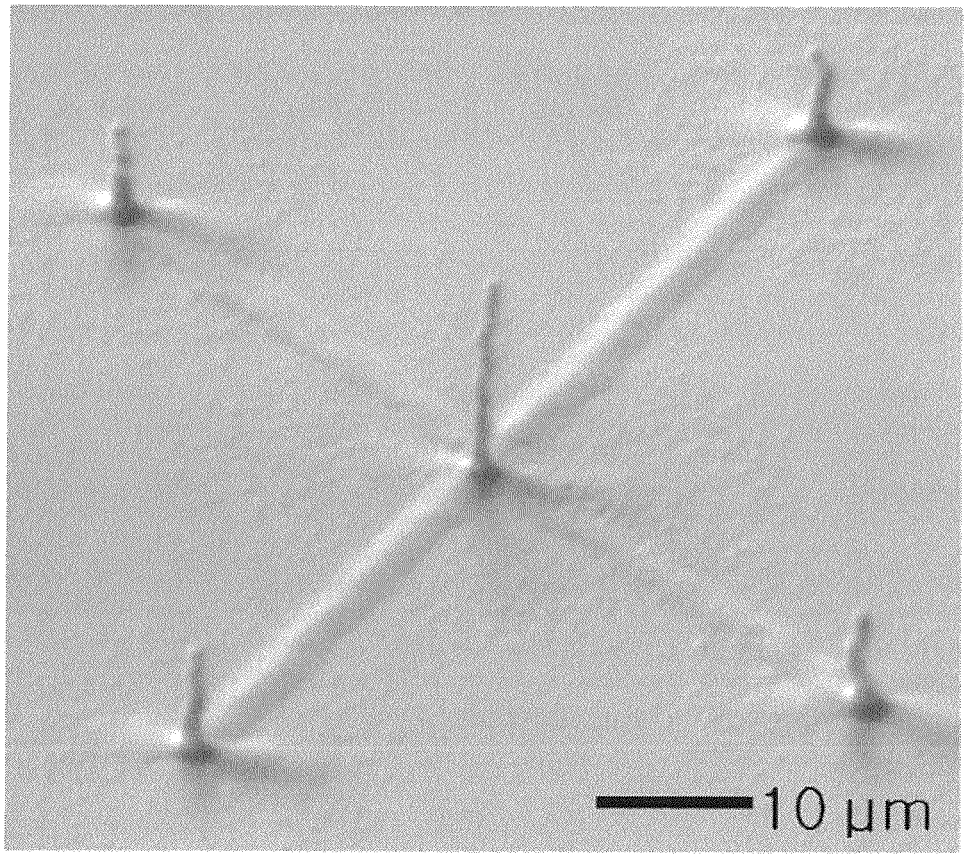

FIG. 11 illustrates an embodiment where fine patterns each having a certain height are formed similarly to FIGS. 9A to 10, and the patterns each having a certain height are formed at a regular distance. When the patterns each having a certain height are formed, there may be an advantage in that a thickness of a metal electrode is increased to reduce a line resistance. As a result, a RC delay is reduced, so that it is possible to implement a high-resolution display panel.

Figure 12:
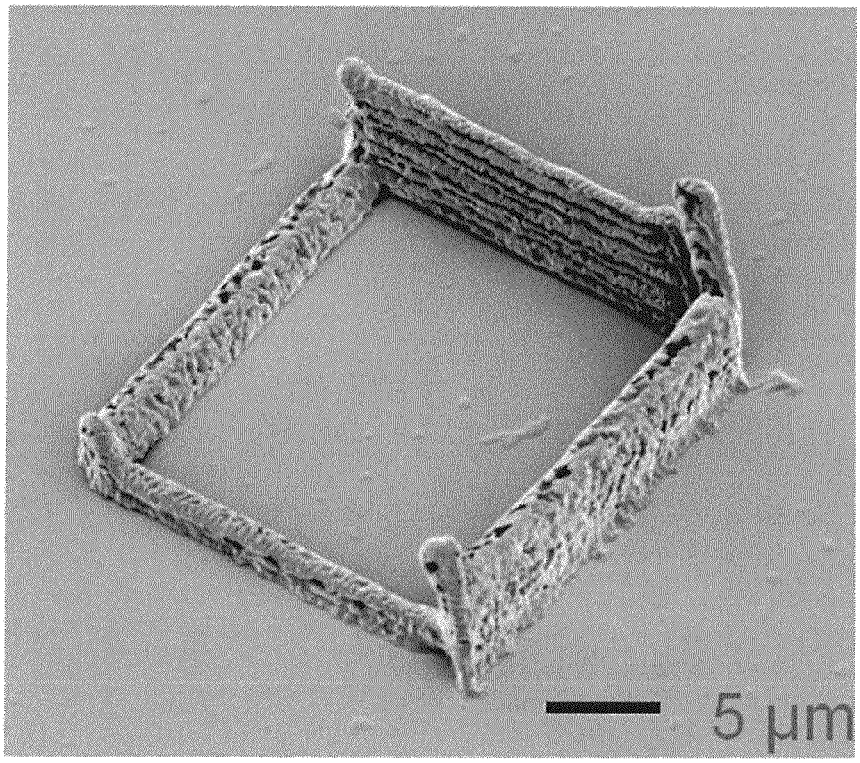

FIG. 12 illustrates an embodiment where patterns each having a certain height are formed and a plane is formed by the patterns. That is, as shown in FIG. 12, the liquid droplet discharge apparatus according to the exemplary embodiment of the present invention can form a three-dimensional pattern.

Figure 13:
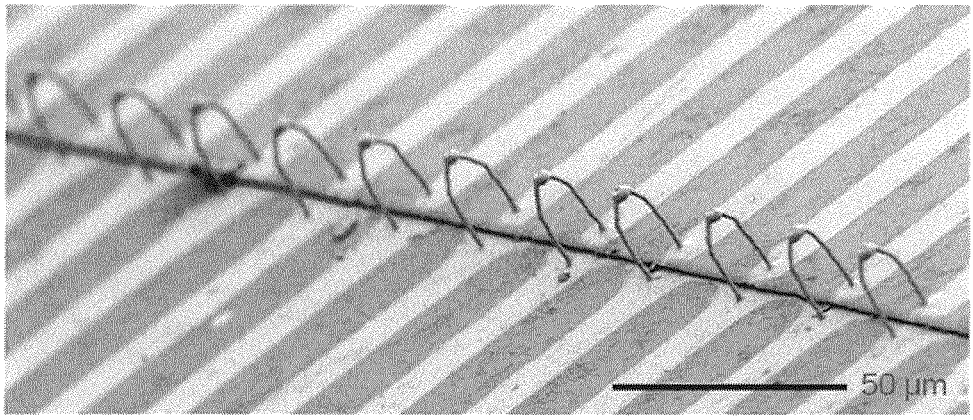

FIG. 13 illustrates of an electrode connecting electrode pads having different heights by forming a three-dimensional pattern.

The pad on the right side has a height of approximately 2 μm higher than the pad on the left side. In order to electrically connect both pads, a three-dimensional electrode is formed by the liquid droplet discharge apparatus according to the exemplary embodiment of the present invention. Since the electrode connects both pads electrically and flexibly, even when both pads are overlapped, the pads can be connected to each other.

Figure 14A:
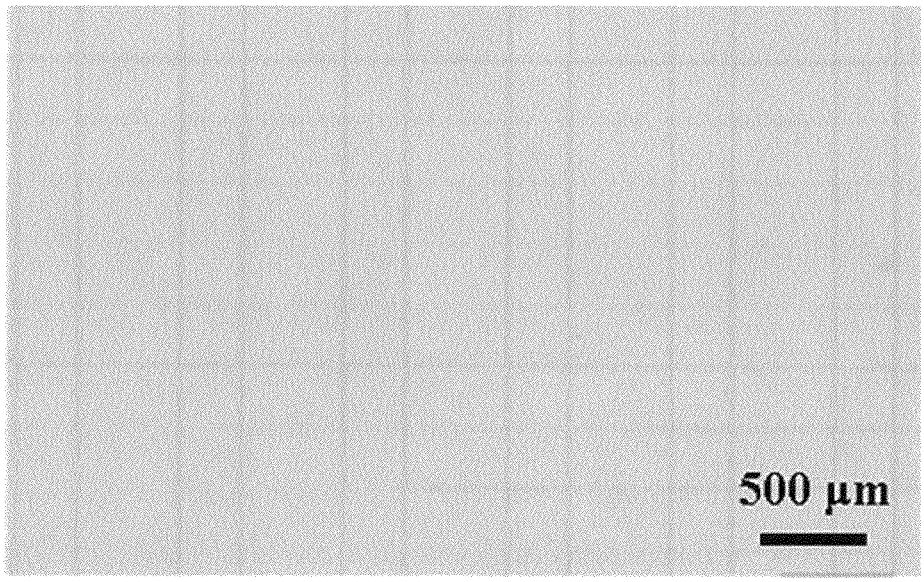
Figure 14B:
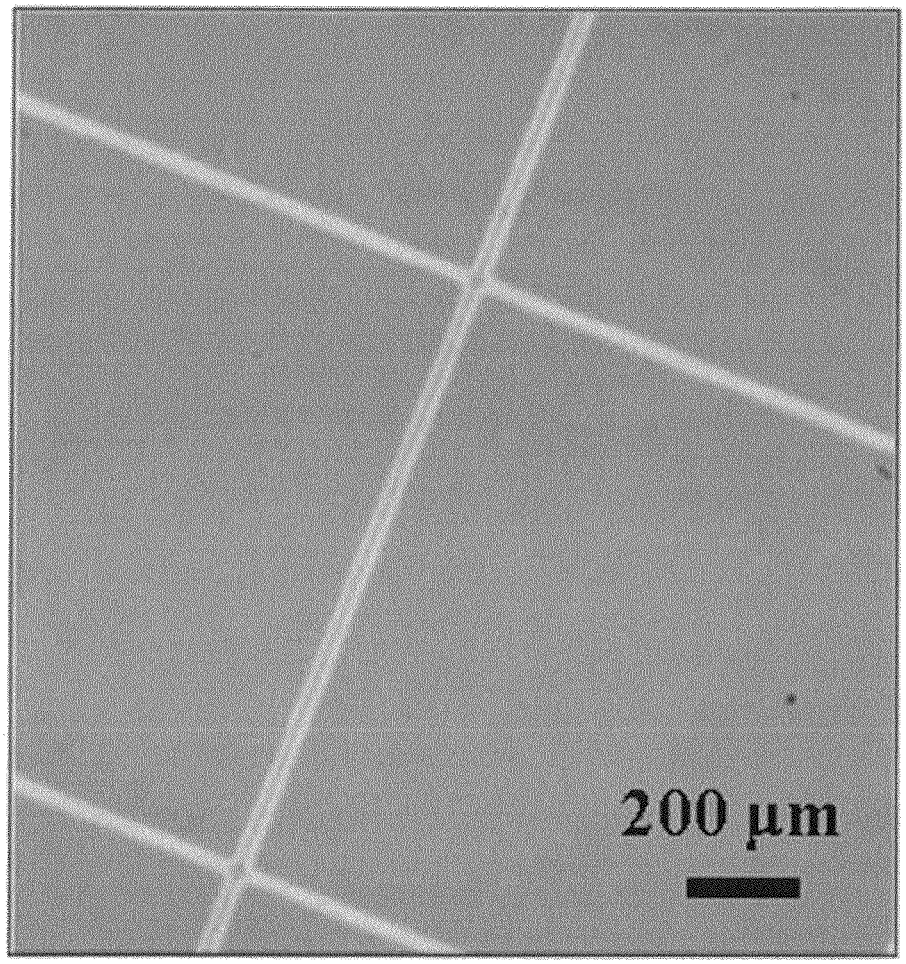
Figure 14C:
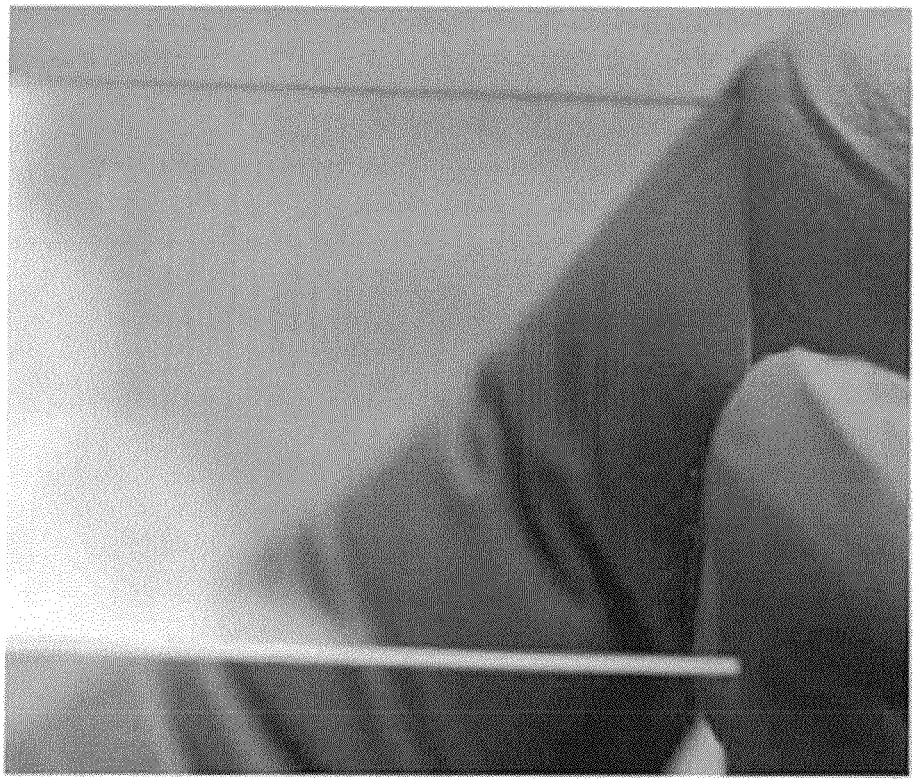

FIGS. 14A to 14C illustrate images of a pattern formed by the liquid droplet discharge apparatus including a plurality of nozzles. The plurality of nozzles forms a lattice pattern having a line width of approximately 2 μm.

Referring to FIGS. 14A and 14B, it can be seen that the liquid droplet discharge apparatus according to another exemplary embodiment of the present invention can form a uniform lattice pattern. In addition, FIG. 14C shows a glass substrate on which a lattice pattern is formed. Although the glass substrate is transparently seen with the naked eye, when a certain printed matter is placed under the glass substrate, the printed matter can be seen.

Figure 15A:
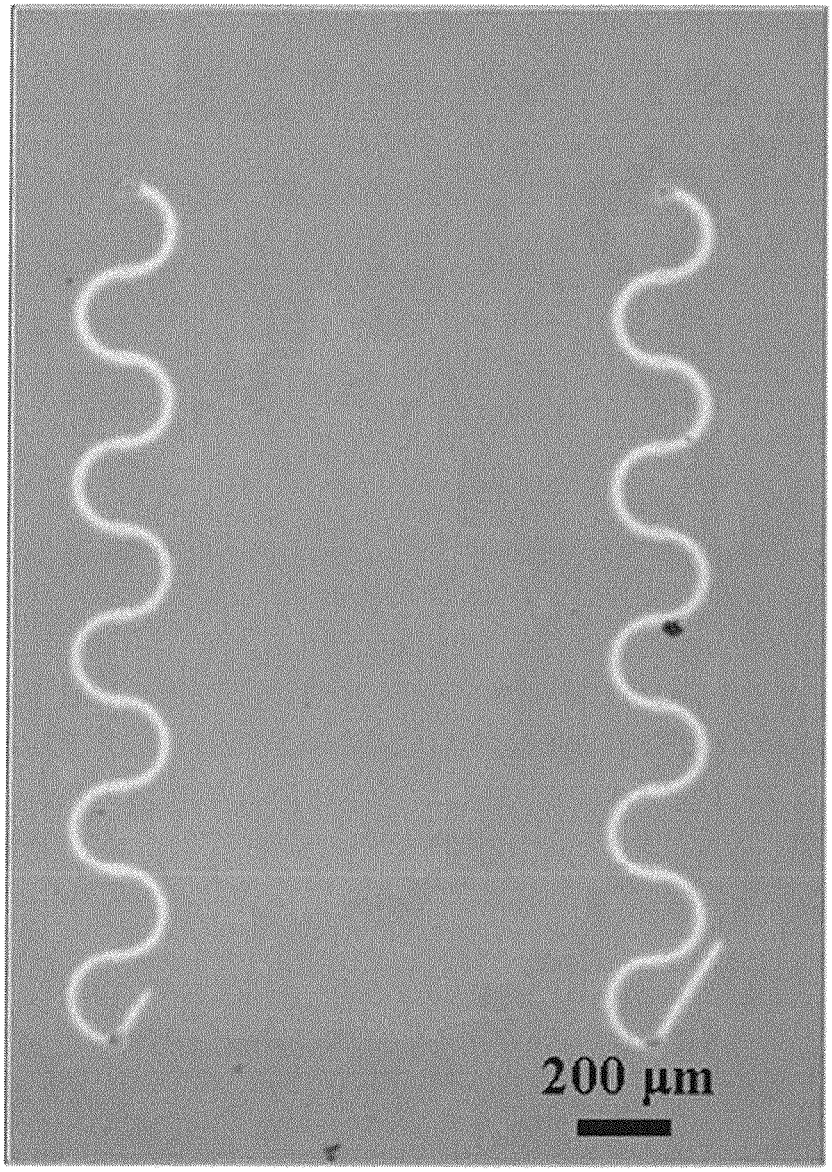
Figure 15B:
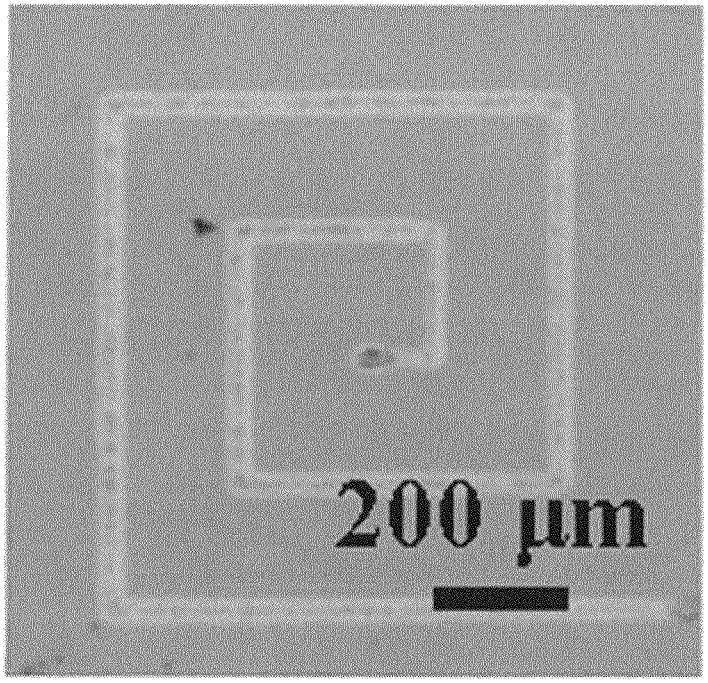

FIGS. 15A and 15B show images of patterns formed by the liquid droplet discharge apparatus including a plurality of nozzles. The plurality of nozzles can form a wave-shaped or coil shaped pattern having a line width of approximately 2 μm.

As can be seen from FIGS. 15A and 15B, the patterns are formed to have uniform line widths, and the patterns are not broken or are not entangled with each other.

The liquid droplet discharge apparatus according to the exemplary embodiment of the present invention can form a three-dimensional pattern as well as a fine pattern and can implement a high-resolution panel in which fine wirings are needed.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| Description of symbols | |
|---|---|
| 100: Liquid droplet discharge unit | 110: Tube |
| 130: Nozzle | 200: Voltage applying unit |
| 300: Pressure controller | 400: Supporting member |
| 500: Ink loading unit | |

What is claimed is:

1. A liquid droplet discharge apparatus comprising:

a liquid droplet discharge unit; and a voltage applying unit that is connected to the liquid droplet discharge unit, wherein the liquid droplet discharge unit includes a nozzle, and a tube that surrounds the nozzle, and wherein the nozzle and the tube are coated with metal, wherein the voltage applying unit is configured to apply different voltages to the nozzle and the tube.

2. The liquid droplet discharge apparatus according to claim 1, wherein:

the nozzle has a diameter of from about 0.3 μm to about 30 μm.

3. The liquid droplet discharge apparatus according to claim 1, wherein:

hydrophobic treatment is performed on one end of the nozzle.

4. The liquid droplet discharge apparatus according to claim 3, wherein:

the hydrophobic treatment is performed using a solvent containing thiol.

5. The liquid droplet discharge apparatus according to claim 4, wherein:

the solvent contains fluoro compounds.

6. The liquid droplet discharge apparatus according to claim 4, wherein:

the one end of the nozzle on which the hydrophobic treatment is performed using the solvent is self-assembled.

7. The liquid droplet discharge apparatus according to claim 1, wherein:

the voltage applying unit is configured to apply a ground voltage to the tube.

8. The liquid droplet discharge apparatus according to claim 1, wherein:

the nozzle comprises a plurality of nozzles.

9. The liquid droplet discharge apparatus according to claim 8, wherein:

the nozzles are made of a polymer or silicon.

10. The liquid droplet discharge apparatus according to claim 9, wherein:

when the nozzles are made of silicon, the liquid droplet discharge apparatus further includes an insulating layer that is connected to the nozzles.

11. The liquid droplet discharge apparatus according to claim 8, wherein:

each of the nozzles includes a fluid supply channel.

12. The liquid droplet discharge apparatus according to claim 8, wherein:

some of the plurality of nozzles include a fluid supply channel spaced apart from one another at a predetermined distance.

13. The liquid droplet discharge apparatus according to claim 12, wherein:

the predetermined distance is at least about 500 μm or more.

14. The liquid droplet discharge apparatus according to claim 1, further comprising:

a pressure controller connected to the liquid droplet discharge unit.

15. The liquid droplet discharge apparatus according to claim 14, further comprising:

an ink loading unit connected to the liquid droplet discharge unit.

16. The liquid droplet discharge apparatus according to claim 1, further comprising:

a supporting member on which a substrate is disposed, wherein the voltage applying unit is connected to the supporting member.

* * * * *